US006976483B2

(12) United States Patent
Ohkuma

(10) Patent No.: US 6,976,483 B2
(45) Date of Patent: Dec. 20, 2005

(54) AIR-FUEL RATIO CONTROL APPARATUS FOR INTERNAL COMBUSTION ENGINE AND METHOD THEREOF

(75) Inventor: Shigeo Ohkuma, Atsugi (JP)

(73) Assignee: Hitachi, Ltd., Tokyo-to (JP)

( * ) Notice: Subject to any disclaimer, the term of this patent is extended or adjusted under 35 U.S.C. 154(b) by 0 days.

(21) Appl. No.: 10/880,577

(22) Filed: Jul. 1, 2004

(65) Prior Publication Data

US 2005/0000504 A1 Jan. 6, 2005

(30) Foreign Application Priority Data

Jul. 4, 2003 (JP) ..... 2003-191841

(51) Int. Cl.[7] ..... F02D 41/06; F02D 41/14

(52) U.S. Cl. ..... 123/697; 123/685; 123/689; 701/109

(58) Field of Search ..... 123/672, 676, 123/685, 688, 689, 697; 701/103, 109; 60/285, 60/286

(56) References Cited

U.S. PATENT DOCUMENTS

| | | | | |
|---|---|---|---|---|
| 6,304,813 | B1 * | 10/2001 | Ikeda et al. | 701/109 |
| 6,696,673 | B2 * | 2/2004 | Okamoto | 123/697 |
| 6,816,774 | B2 * | 11/2004 | Yasui et al. | 701/109 |
| 6,879,906 | B2 * | 4/2005 | Makki et al. | 701/109 |
| 2002/0078938 | A1 * | 6/2002 | Hada et al. | 123/697 |

FOREIGN PATENT DOCUMENTS

JP 9-088688 A 3/1997

* cited by examiner

*Primary Examiner*—Erick Solis
(74) *Attorney, Agent, or Firm*—Foley & Lardner LLP

(57) ABSTRACT

When an internal combustion engine is in a low load and low rotation operation, and also an elapsed time after the starting of engine operation is less than a predetermined period of time, a heater heating an air-fuel ratio sensor is turned OFF, to stop an air-fuel ratio feedback control. When the internal combustion engine is in the low load and low rotation operation after the predetermined period of time has elapsed, a low voltage is applied to the heater and also a gain is lowered, to perform the air-fuel ratio feedback control.

21 Claims, 2 Drawing Sheets

AIR-FUEL RATIO CONTROL APPARATUS FOR INTERNAL COMBUSTION ENGINE AND METHOD THEREOF

FIELD OF THE INVENTION

The present invention relates to an air-fuel ratio control apparatus and a method thereof, for detecting an air-fuel ratio based on the concentration of a specific component in an exhaust gas of an internal combustion engine, to feedback control the air-fuel ratio in the internal combustion engine based on the detection result.

RELATED ART

Japanese Unexamined Patent Publication No. 09-088688 discloses an air-fuel ratio control apparatus in which a heater is disposed on an exhaust sensor detecting an air-fuel ratio in an internal combustion engine based on the oxygen concentration in an exhaust gas, and the exhaust sensor is heated by the heater, to be kept in an activated condition.

In an internal combustion engine for motorcycle, the engine displacement is small and also the thermal capacity of an exhaust pipe is small, compared with an internal combustion engine for automobile.

Therefore, when an exhaust heat amount is small, such as an idle operating time or a low speed running time of a motorcycle engine, a temperature change in an exhaust system is large and condensed water is easy to be generated.

Then, under conditions where the temperature change is large and the condensed water is generated, sometimes, an element of the exhaust sensor is cracked due to the heating by the heater.

However, if an applied voltage to the heater is suppressed so that the element of the exhaust sensor is not cracked, there is a case where the exhaust sensor cannot be sufficiently heated by the heater.

If the exhaust sensor is not sufficiently heated, a characteristic of the exhaust sensor is changed so that a gain for an air-fuel ratio feedback control becomes inconsistent, thereby significantly lowering the feedback control accuracy.

SUMMARY OF THE INVENTION

The present invention has an object to provide an air-fuel ratio control apparatus capable of avoiding an element crack in an exhaust sensor, and also preventing the accuracy of an air-fuel ratio feedback control from being lowered.

In order to achieve the above object, an air-fuel ratio control apparatus according to the present invention, comprises a concentration detector detecting the concentration of a specific components in an exhaust gas of an internal combustion engine and a heater heating the concentration detector, wherein an air-fuel ratio in the internal combustion engine is feedback controlled based on a detection signal from the concentration detector, and also a gain for the feedback control is set according to manipulated variable of the heater set based on engine operating conditions.

The other objects and features of this invention will become understood from the following description with reference to the accompanying drawings.

DESCRIPTION OF EMBODIMENT

Figure 1:
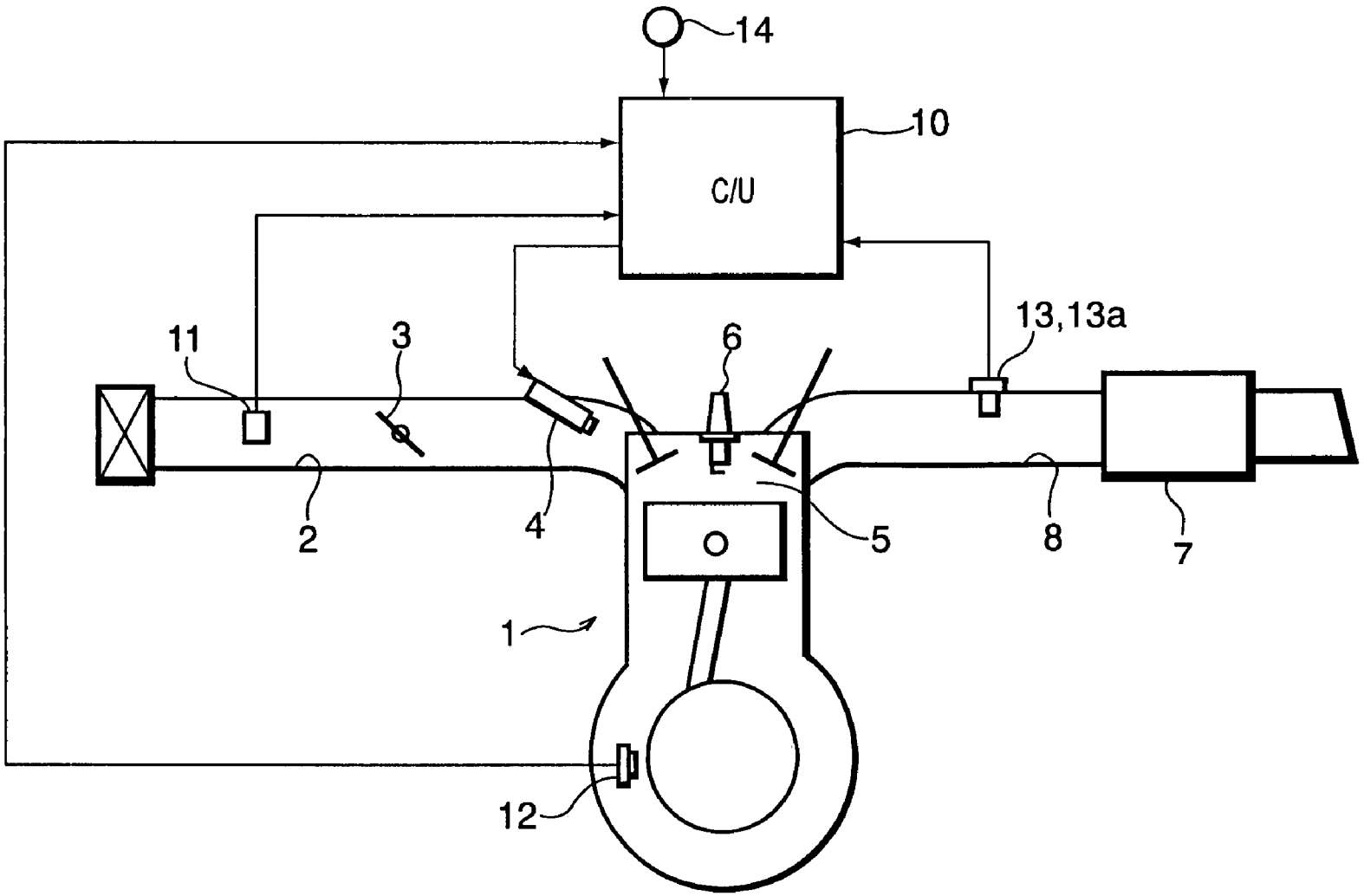
FIG. 1 is a diagram showing a system configuration of an internal combustion engine in an embodiment.

FIG. 1 is diagram showing a system configuration of a single-cylinder internal combustion engine for motorcycle in an embodiment.

In FIG. 1, a throttle valve 3 is disposed in an intake pipe 2 of an internal combustion engine 1, and an intake air amount in internal combustion engine 1 is controlled by means of throttle valve 3.

A fuel injection valve 4 is disposed in intake pipe 2 on the downstream of throttle valve 3.

In a combustion chamber 5, an air-fuel mixture is formed of fuel injected from fuel injection valve 4 and air passed through throttle valve 3.

The air-fuel mixture is ignited to burn in combustion chamber 5, with spark ignition by an ignition plug 6.

Combusted exhaust gas is discharged via an exhaust pipe 8, on the halfway of which is disposed a catalytic converter 7.

Fuel injection valve 4 is driven to open according to an injection pulse signal from a control unit 10 incorporating therein a microcomputer, and a fuel injection quantity is controlled based on pulse width of the injection pulse signal.

Control unit 10 receives detection signals from various sensors, to output the injection pulse signal by the calculation process based on the detection signals.

As the various sensors, there are provided an air flow meter 11 detecting the intake air amount at the upstream side of throttle valve 3, a rotation sensor 12 detecting a rotation speed of internal combustion engine 1, an air-fuel ratio sensor 13 detecting the oxygen concentration inside exhaust pipe 8 on the upstream side of catalytic converter 7, and a vehicle speed sensor 14 detecting a vehicle speed.

Air-fuel ratio sensor 13 is provided with a heater 13*a* heating a sensor element.

Note, air-fuel ratio sensor 13 may be the one detecting in a wide range the air-fuel ratio from the oxygen concentration in the exhaust gas, or the one only detecting whether the air-fuel ratio is richer or leaner than a stoichiometric air-fuel ratio.

Here, control unit 10 feedback controls the pulse width of the injection pulse signal to be output to fuel injection valve 4, so that the air-fuel ratio detected by air-fuel ratio sensor 13 is coincident with the stoichiometiric air-fuel ratio.

Further, control unit 10 controls an applied voltage to heater 13*a* provided on air-fuel ratio sensor 13.

Figure 2:
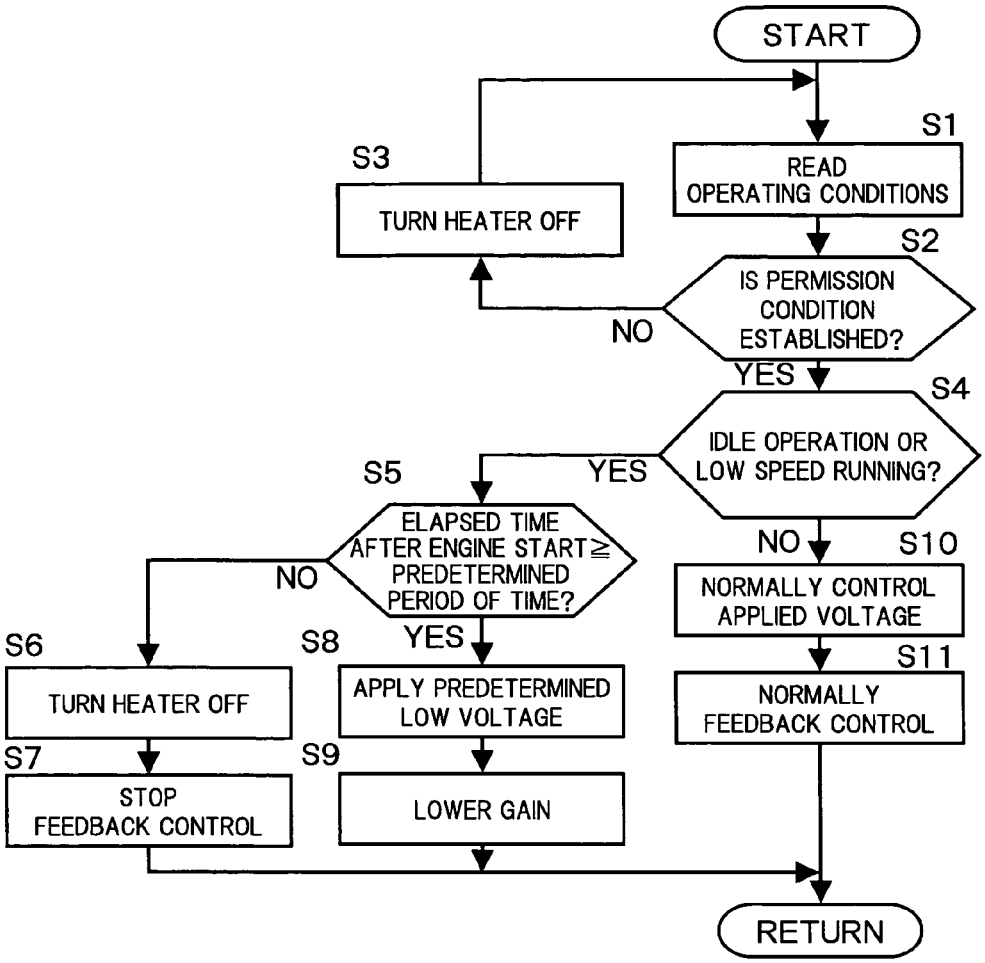
FIG. 2 is a flowchart showing a heater control and the setting of an air-fuel ratio feedback gain in the embodiment.

A flowchart of FIG. 2 shows a heater applied voltage control and a feedback gain control, by control unit 10.

In step S1, various operating conditions, such as the vehicle speed, the engine rotation speed, the engine intake air amount and the like, are read.

In step S2, it is judged whether or not a permission condition for the heater control is established.

Here, as the permission condition for the heater control, there are made the judgments that the failures of each component and system are not judged, that a power source voltage for heater 13*a* is a predetermined voltage or above, and the like.

If the permission condition for the heater control is not established, after the power supply to heater 13*a* is shut off in step S3, control returns to step S1.

On the other hand, if the permission condition for the heater control is established, control proceeds to step S4.

In step S4, it is judged whether or not internal combustion engine 1 is in an idle operating condition or a low speed running condition at a predetermined speed or less.

If internal combustion engine 1 is in the idle operating condition or the low speed running condition, internal combustion engine 1 is operated within a predetermined low load and low rotation region inclusive of the idling.

In the low load and low rotation operation of internal combustion engine 1, the heat amount from the exhaust gas of air-fuel ratio sensor 13 is small and therefore, the temperature of air-fuel ratio sensor 13 is easy to be changed. At this time, control proceeds to step S5.

In step S5, it is judged whether or not an elapsed time after the starting of operation of internal combustion engine 1 is a predetermined period of time (for example, 200 seconds) or more.

If the elapsed time is less than the predetermined period of time, control proceeds to step S6.

In step S6, the power supply to heater 13*a* is shut off and then, control proceeds to step S7, where the air-fuel ratio feedback control is stopped.

Namely, in the case where internal combustion engine 1 is in the low load and low rotation operating condition, the heat amount from the exhaust gas of air-fuel ratio sensor 13 is small, and the elapsed time after the starting of operation of internal combustion engine 1 is short, it is estimated that the temperature of air-fuel ratio sensor 13 does not rise substantially.

Even if the sensor element is heated by applying the voltage to heater 13*a* in the above condition, there is a possibility of element crack by a thermal shock due to condensed water, which has been collected in exhaust pipe 8 during the operation stop of internal combustion engine 1.

Further, under a condition where the combustion of internal combustion engine is not stabled just after the starting of engine operation, even if air-fuel ratio sensor 13 operates normally, it is hard to execute stably the air-fuel ratio feedback control.

Therefore, when the elapsed time after the starting of engine operation is less than the predetermined period of time, heater 13*a* is turned OFF and also the air-fuel ratio feedback control is stopped.

On the other hand, it is judged in step S5 that the predetermined period of time or more has elapsed after the starting of engine operation, it is estimated that the temperature of air-fuel ratio sensor 13 rises to some extent by the exhaust heat.

However, since internal combustion engine 1 is in the low rotation and low load operating condition, and accordingly, the heat amount from the exhaust gas of air-fuel ratio sensor 13 is small, the temperature of exhaust pipe 8 and air-fuel ratio sensor 13 is easy to be varied and the condensed water is easy to be generated.

Therefore, control proceeds to step S8, where heater 13*a* is applied with a fixed voltage, which is low of the degree at which the element crack does not occur by the thermal shock caused by the hitting of the condensed water against the sensor element.

Further, when control proceeds to step S8, where the voltage is applied to heater 13*a*, a response characteristic of air-fuel ratio sensor 13 is improved compared with that just after the starting of engine operation. However, if the feedback control is executed using the gain of warmed-up time, the overshooting occurs due to a response delay of air-fuel ratio sensor 13.

Therefore, in step S9, the feedback gain is made to be lower than a normal value used at the warmed-up time of air-fuel ratio sensor 13, to perform the air-fuel ratio feedback control.

Accordingly, it is possible to start the air-fuel ratio feedback control at an early time while avoiding the occurrence of element crack, thereby enabling the improvement of emission performance and engine drivability.

Further, when it is judged in step S4 that internal combustion engine 1 is neither in the idle operating condition nor in the low speed running condition, it is judged that exhaust pipe 8 and air-fuel ratio sensor 13 are stabled at the relatively high temperature due to the heat from the exhaust gas.

Then, since the condensed water is not generated in the state where exhaust pipe 8 and air-fuel ratio sensor 13 are stabled at the high temperature, it is judged that the possibility of element crack is low if the voltage is applied to heater 13*a* so as to hold the sensor element in the warmed-up condition.

Therefore, when it is judged in step S4 that internal combustion engine 1 is neither in the idle operating condition nor in the low speed running condition, control proceeds to step S10.

In step S10, a normal heater control is executed.

The normal heater control described above is a control for referring to a map storing applied voltages according to the engine load and rotation speed or the engine load and vehicle speed, and applying the voltage corresponding to the engine load and rotation speed or the engine load and vehicle speed at the time to heater 13*a*.

Moreover, the heater control may be the one for estimating the sensor temperature based on an inner resistance of air-fuel ratio sensor 13, and feedback controlling the applied voltage based on a deviation between this temperature and the target temperature.

Further, the applied voltage may be fixed at a relatively high value.

By controlling the heater in step S10, air-fuel ratio sensor 13 exhibits a required and sufficient response characteristic.

Therefore, in next step S11, the feedback gain is set to a normal gain, which is higher than the gain set in step S9.

Note, in the above embodiment, the applied voltage to the heater is changed in stepwise based on the judgment results in step S4 and step S5. However, the constitution may be such that the applied voltage to the heater is gradually changed to the applied voltage after the switching.

Further, the constitution may be such that control proceeds to step 5 on the condition that the idle operating condition or the low speed running condition has continued for a predetermined period of time in step S4.

According to such a constitution, just after the engine operation is shifted to the idle operation or the low speed running from the condition where exhaust pipe 8 and air-fuel ratio sensor 13 are sufficiently warmed-up in the medium/high speed operation, the heater control and the air-fuel ratio feedback control are normally performed. When the idle operation or the low speed running has continued for the predetermined period of time, the applied voltage to the heater and the gain are lowered.

The entire contents of Japanese Patent Application No. 2003-191841 filed on Jul. 4, 2003, a priority of which is claimed, are incorporated herein by reference.

While only a selected embodiment has been chosen to illustrate the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and not for the purpose of limiting the invention as defined in the appended claims and their equivalents.

What is claimed is:

1. An air-fuel ratio control apparatus for an internal combustion engine, comprising:

a fuel injector injecting fuel to said internal combustion engine;

an operating condition detector detecting operating conditions of said internal combustion engine;

a concentration detector detecting the concentration of a specific component in an exhaust gas of said internal combustion engine;

a heating device heating said concentration detector; and a control unit that receives detection signals from said operating condition detector and said concentration detector, to feedback control manipulated variable to be added to said fuel injector based on the detection signal from said concentration detector, and also to calculate manipulated variable to be added to said heating device, based on the detection signal from said operating condition detector, wherein said control unit;

variably sets the manipulated variable of said heating device according to said operating conditions, and also switches a gain for said feedback control according to the manipulated variable of said heating device.

2. An air-fuel ratio control apparatus for an internal combustion engine according to claim 1, wherein said operating condition detector detects at least one of a speed of vehicle on which said internal combustion engine is installed, a load of said internal combustion engine, a rotation speed of said internal combustion engine, and an elapsed time after an operation of said internal combustion engine is started.

3. An air-fuel ratio control apparatus for an internal combustion engine according to claim 1, wherein said control unit;

sets the gain for said feedback control to be smaller as the manipulated variable of said heating device is lower.

4. An air-fuel ratio control apparatus for an internal combustion engine according to claim 1, wherein said control unit;

estimates a heat amount from an exhaust gas of said concentration detector based on the operating conditions detected by said operating condition detector, to variably set the manipulated variable of said heating device according to the estimated heat amount.

5. An air-fuel ratio control apparatus for an internal combustion engine according to claim 4, wherein said control unit;

lowers the manipulated variable of said heating device and also lowers the gain for said feedback control, in the operating condition where the heat amount from the exhaust gas of said concentration detector is low, and also at the time when an elapsed time after an operation of said internal combustion engine is started, exceeds a predetermined period of time.

6. An air-fuel ratio control apparatus for an internal combustion engine according to claim 4, wherein said control unit:

lowers the manipulated variable of said heating device and also lowers the gain for said feedback control, in the operating condition where the heat amount from the exhaust gas of said concentration detector is low, and also at the time when an elapsed time after an operation of said internal combustion engine is started, exceeds a predetermined period of time; and stops the heating of said concentration detector by said heating device and also stops said feedback control, in the operating condition where the heat amount from the exhaust gas of said concentration detector is low, and also at the time when the elapsed time after the operation of said internal combustion engine is started, is equal to or less than the predetermined period of time.

7. An air-fuel ratio control apparatus for an internal combustion engine according to claim 4, wherein said control unit;

judges an idle operating condition of said internal combustion engine as the operating condition where the heat amount from the exhaust gas of said concentration detector is low.

8. An air-fuel ratio control apparatus for an internal combustion engine according to claim 4, wherein said control unit;

judges a condition where a speed of vehicle on which said internal combustion engine is installed, is lower than a predetermined speed, as the operating condition where the heat amount from the exhaust gas of said concentration detector is low.

9. An air-fuel ratio control apparatus for an internal combustion engine according to claim 4, wherein said control unit;

makes the manipulated variable of said heating device in the operating condition where the heat amount from the exhaust gas of said concentration detector is low, to be lower than that in the operating condition where the heat amount from the exhaust gas is high.

10. An air-fuel ratio control apparatus for an internal combustion engine according to claim 1, wherein said heating device is a heater, and said control unit;

variably sets an applied voltage to said heater according to said operating conditions, and also switches the gain for said feedback control according to said applied voltage.

11. An air-fuel ratio control apparatus for an internal combustion engine according to claim 1, wherein said internal combustion engine is a single-cylinder internal combustion engine for motorcycle.

12. An air-fuel ratio control apparatus for an internal combustion engine, comprising:

fuel injecting means for injecting fuel to said internal combustion engine;

operating condition detecting means for detecting operating conditions of said internal combustion engine;

concentration detecting means for detecting the concentration of a specific component in an exhaust gas of said internal combustion engine;

heating means for heating said concentration detecting means;

heating control means for calculating manipulated variable to be added to said heating means based on a detection signal from said operating condition detecting means;

feedback control means for feedback controlling manipulated variable to be added to said fuel injecting means based on a detection signal from said concentration detecting means; and gain switching means for switching a gain for said feedback control according to the manipulated variable of said heating means.

13. An air-fuel ratio control method for an internal combustion engine, equipped with a concentration detector detecting the concentration of a specific component in an exhaust gas of said internal combustion engine and a heating device heating said concentration detector, comprising the steps of:

detecting operating conditions of said internal combustion engine;

calculating manipulated variable of said heating device based on said operating conditions;

setting a gain according to the manipulated variable of said heating device; and feedback controlling an air-fuel ratio of said internal combustion engine based on said gain and a detection signal from said concentration detector.

14. An air-fuel ratio control method for an internal combustion engine according to claim 13, wherein said step of detecting the operating conditions comprises the step of;

detecting at least one of a speed of vehicle on which said internal combustion engine is installed, a load of said internal combustion engine, a rotation speed of said internal combustion engine, and an elapsed time after an operation of said internal combustion engine is started.

15. An air-fuel ratio control method for an internal combustion engine according to claim 13, wherein said step of setting the gain comprises the step of;

setting the gain for said feedback control to be smaller as the manipulated variable of said heating device is lower.

16. An air-fuel ratio control method for an internal combustion engine according to claim 13, wherein said step of calculating the manipulated variable of said heating device based on the operating conditions comprises the steps of:

estimating a heat amount from an exhaust gas of said concentration detector based on the operating conditions; and variably setting the manipulated variable of said heating device according to the estimated heat amount.

17. An air-fuel ratio control method for an internal combustion engine according to claim 16, wherein said step of variably setting the manipulated variable of said heating device according to the heat amount comprises the steps of:

judging whether the heat amount is low or high;

judging whether or not an elapsed time after an operation of said internal combustion engine is started, exceeds a predetermined period of time, when said heat amount is low; and setting the manipulated variable of said heating device to previously set low manipulated variable, when the heat amount is low and also the elapsed time after the operation of said internal combustion engine is started, exceeds the predetermined period of time, and further said step of setting the gain comprises the step of;

lowers the gain for said feedback control, when the manipulated variable of said heating device is set to said low manipulated variable.

18. An air-fuel ratio control method for an internal combustion engine according to claim 16, wherein said step of variably setting the manipulated variable of said heating device according to the heat amount comprises the steps of:

judging whether the heat amount is low or high;

judging whether or not an elapsed time after an operation of said internal combustion engine is started, exceeds a predetermined period of time, when said heat amount is low;

setting the manipulated variable of said heating device to previously set low manipulated variable, when the heat amount is low and also the elapsed time after the operation of said internal combustion engine is started, exceeds the predetermined period of time; and setting the manipulated variable of said heating device to zero, when the heat amount is low and also the elapsed time after the operation of said internal combustion engine is started, equals to or less than the predetermined period of time, and further said step of setting the gain comprises the step of:

lowers the gain for said feedback control, when the manipulated variable of said heating device is set to said low manipulated variable; and stops said feedback control, when the manipulated variable of said heating device is set to zero.

19. An air-fuel ratio control method for an internal combustion engine according to claim 16, wherein said step of estimating the heat amount based on the operating conditions comprises the step of;

judging an idle operating condition of said internal combustion engine as the operating condition where the heat amount is low.

20. An air-fuel ratio control method for an internal combustion engine according to claim 16, wherein said step of estimating the heat amount based on the operating conditions comprises the step of;

judging a condition where a speed of vehicle on which said internal combustion engine is installed, is lower than a predetermined speed, as the operating condition where the heat amount is low.

21. An air-fuel ratio control method for an internal combustion engine according to claim 16, wherein said step of variably setting the manipulated variable of said heating device according to the heat amount comprises the step of;

making the manipulated variable of said heating device at the time when the heat amount is low, to be lower than that at the time when the heat amount is high.

* * * * *